United States Patent [19]

Makow

[11] Patent Number: 4,635,939

[45] Date of Patent: Jan. 13, 1987

[54] QUESTION AND ANSWER GAME APPARATUS AND METHOD

[75] Inventor: Henry Makow, Manitoba, Canada

[73] Assignee: Hasbro Canada, Inc., Quebec, Canada

[21] Appl. No.: 794,701

[22] Filed: Nov. 4, 1985

[51] Int. Cl.[4] ..... A63F 1/00

[52] U.S. Cl. ..... 273/296

[58] Field of Search ..... 273/292, 296

[56] References Cited

U.S. PATENT DOCUMENTS

| | | | |
|---|---|---|---|
| 855,681 | 6/1907 | Ward | 273/292 |
| 1,314,522 | 9/1919 | Knoos | 273/292 |
| 3,815,919 | 6/1974 | Cain et al. | 273/249 |
| 4,090,717 | 5/1978 | Rossetti | 273/249 |
| 4,124,214 | 11/1978 | Pavis | 273/249 |
| 4,199,146 | 4/1980 | Dato | 273/292 X |

OTHER PUBLICATIONS

"Ethics", Games Master Catalog, publ. by Boynton & Ass., copyright, 1980, p. 167.

*Primary Examiner*—Anton O. Oechsle
*Attorney, Agent, or Firm*—Salter & Michaelson

[57] ABSTRACT

Game playing apparatus consists of a set of question cards bearing moral questions to which a positive, negative, or indeterminate answer may be given. Also provided is a set of answer cards, each bearing an answer selected from a positive, negative and indeterminate answer. Each player has a number of question cards, and one randomly selected answer card. His object is to select a question and one of the other players to answer it in such manner that the answer he receives matches the answer given on the answer card that he holds. In such case, he advances toward winning by disposing of the question card without replacing it with a fresh question card. The skill in playing therefore lies in a questioner anticipating which of the players is most likely to give the desired answer to a particular moral question. Those answering questions can use their skill to guess what type of answer is hoped for and to thwart the qustioner by giving another answer from the three types. The other players may be permitted to challenge the sincerity of the answer that is given and, a poll may be taken as to whether the answer is sincere. In the event that the questioner successfully persuades the players that the answer given was insincere, the person giving the answer is penalized by accepting a further question card. In the event of an unsuccessful challenge, the person issuing the challenge accepts a question card from the person challenged. The winner is the person who first disposes of all his question cards.

13 Claims, 8 Drawing Figures

A QUESTION OF SCRUPLES A QUESTION OF SCRUPLES A QUESTION OF SCRUPLES

Figure 1A:
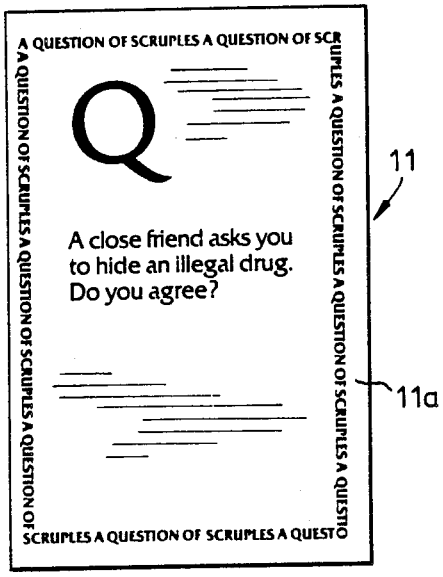

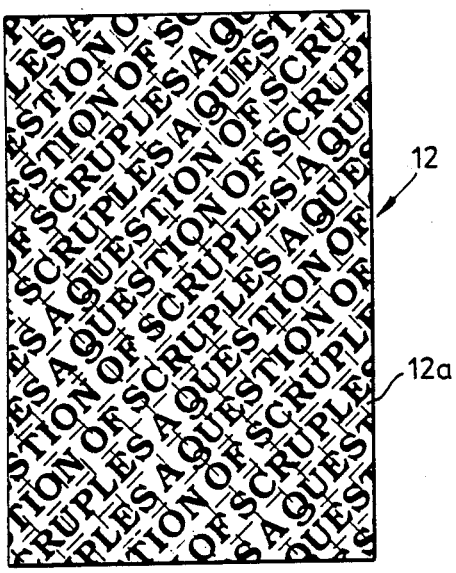
FIG. 2a
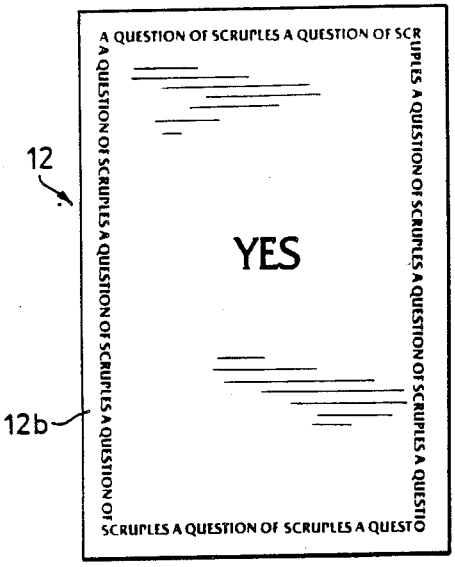
12
YES
12b
A QUESTION OF SCRUPLES A QUESTION OF SCRUPLES A QUESTION OF SCRUPLES

QUESTION AND ANSWER GAME APPARATUS AND METHOD

The present invention relates to apparatus and methods for playing games, more especially games requiring players to make character assessments of other players, and to employ predictive abilities, and which can serve to inculcate in the players an awareness of moral issues, as well as permitting exercise of their powers of persuasive discussion.

In one form of playing apparatus according to the invention, there is a set of question playing pieces of like shape, each of which has a front and a reverse side. The reverse sides are all of a first like appearance, so that when viewed from the reverse a number of such pieces held in a player's hand are indistinguishable one from the other. The front side of each piece bears a legend which poses a moral question to which a positive, a negative or an indeterminate answer may be given. The apparatus also comprises a set of answer playing pieces of like shape, which may not be, but preferably are, of the same shape as the question pieces. The answer pieces have reverse sides of a second like appearance distinctive from the question pieces, so that they are readily distinguished from the question pieces but indistinguishable from one another when viewed from the reverse. Each of the answer pieces carries on its front side a legend indicating an answer selected from the three types of positive, negative and indeterminate. There are in the answer set a plurality of playing pieces bearing answers of each of said three types.

Such playing pieces are adapted for playing a game which requires each player to make assessments of the characters of the other players, and to employ predictive abilities to predict the responses of other players to particular situations, which, in the present game, raise moral issues. Such game may consist in each player being dealt an equal number of question playing pieces, and one of the answer pieces. A first player is selected, e.g. the person next to the dealer in the clockwise direction. The first player selects a question from the question pieces held in his hand, and poses it to another player selected by him, and elicits from the second player a response which according to the rules of the game must be positive, negative or indeterminate. According to the rules of the game, the second player must justify an indeterminate response by explaining the further facts which he would need in order to provide a definite positive or definite negative response. Thus, for example, the permitted form of indeterminate answer may be "depends", and, in such case, the second player must always indicate on which facts his decision depends. In the preferred form of the game, as provided by the rules, if a player forgets to say on what facts his decision depends, or hesitates too long, he is penalized by having to draw an additional question piece. The first player then reveals the front sides of his question piece and of his answer. If the second player's answer matches that of the first player's answer piece, the first player is entitled to dispose of his question piece carrying the question he selected as well as his answer piece thus reducing the number of question pieces in his hand by one, and advancing him toward winning the game, which is achieved by disposing of all of his question pieces.

If the second player's answer does not match the answer on the answer piece held by the first player, then, again, the first player disposes of his question and answer playing pieces, but, in this case, takes a further question piece from a stack of the playing pieces which are maintained in a position readily accessible by each player. In such case, the first player has not decreased the number of question pieces in his hand, and has not advanced toward winning. In any event, the first player then takes a further answer piece to replace the answer piece he has discarded, and the turn of play passes to the next player who then becomes the "first player" in the sequence described above. The turn to play may proceed clockwise from the dealer, for example.

As will be appreciated, each player maintains his playing pieces so that only their reverse sides are visible to other players, so that no player can discern the questions or the types of answer which the other players hold.

It will be appreciated that with the above form of game, each player needs to make assessments of the characters of the other players in order to make a prediction as to which player in the group is most likely to furnish him with the answer which he requires, in order to match his answer playing piece, for a question selected from the questions which he holds on his question playing pieces. The person to whom the question is posed may guess, as a result of his assessment of the question and of the character of the questioner, that the first player is seeking a particular type of answer, and can thwart that player by giving an opposite answer, and thus elements of bluff can enter the game.

In a preferred form of the game apparatus, the apparatus includes a set of two-sided balloting pieces, each of which has on one side a symbol representing sincerity and, on the opposite side, a symbol representing insincerity. The balloting pieces are adapted for playing a more complex, or full version of the game, for which the above-described or basic version may serve a preliminary or introductory function. In the full version, the answer given by the second player can be challenged if it is considered untruthful. Play proceeds as described in the above-described basic version of the game. After the second player has given his response to the question posed by the first player, and the first player has disposed of or replaced his question piece, and has replaced his answer piece, the first player has an opportunity to elect to challenge the answer given by the second player. In a challenge, the first player has a limited period, as defined by the rules of the game, in which to convince the other players that the second player is insincere in the reply which he has given. Following this period, the second player has a further limited period in which to convince the group of players that he is sincere in his reply. The challenger then has a final brief period of limited duration in which to present his case for the insincerity of the second player's answer. Following this period, all of the players vote for the sincerity or insincerity of the second player's answer, including the first and second players. The poll is conducted by each player casting one of the above-mentioned balloting pieces onto a suitable playing surface, for example onto a table top, with the symbol representing each player's opinion as to the sincerity or insincerity of the answer uppermost. In the event that a majority of the players decide that the second player's answer was insincere, the challenger advances by giving the second player a question playing piece from his hand. In the event that the majority finds that the second player's answer is sincere, the second player advances by giving the challenger a question piece from his hand. If the result of the ballot is a tie, no playing piece is exchanged. Following the ballot, play proceeds, and the turn of play passes to the next player.

In the event that the first player elects not to challenge the answer given by the second player, any other player may present a challenge to the sincerity of the second player's answer. The person who is first to indicate that he wishes to make a challenge has the opportunity to make the challenge, and the procedure for determining the outcome of the challenge is as described above. Only the second player and the actual challenger exchange question playing pieces. The person who originally passed the question to the second player does not benefit from another's successful challenge and is not penalized as a result of another's unsuccessful challenge.

It will be seen that, whereas with the basic or introductory form of game described above a player is free to bluff in his response, to thwart a questioner, with the full version, a bluff is made at the risk that the bluff will be called and the bluffer penalized if the players are convinced his answer is insincere.

In the playing apparatus there should desirably be equal numbers of answer pieces bearing positive, negative and indeterminate answers, respectively, so that on dealing an answer playing piece from a stack of the pieces arranged in random order, a selection as random as possible is made of the type of answer allocated to each player. The apparatus may also include a number of pieces each having their reverse sides the same as the question pieces, but having on the front side a legend inviting the player to invent a moral question. According to the rules of the game, a player holding such piece in his hand must formulate and pose to the second player a moral question of his own devising, or if successful in a challenge can pass this piece to another player in the exchange of question pieces.

The playing pieces may also include playing pieces like the question piece on the reverse side, and having a blank space on the front side, in which users of the apparatus may write preferred moral questions of their own choosing.

In the apparatus, the number of different moral questions carried by the question pieces should be sufficient that, in normal circumstances of the playing of the game in the home, the players of the game will not become familiar with all of the questions in too rapidly. Desirably, however, the number of different questions is not excessively large, since this merely increases the costs of printing and assembly of the apparatus, without necessarily increasing the utility of the apparatus. Preferably, the apparatus comprise about 100 to 600, more preferably about 200 to 500 different questions. Such apparatus is readily usable for prolonged periods for games played by groups of from 3 to 10 people in each group. In such apparatus, in order to provide for adequate randomness of selection of answer playing pieces of the second set, and to preclude any player being able to discern the type of answer likely indicated on the answer cards held by his co-players, the set of answer playing pieces should preferably comprise about 4 to about 20 pieces bearing ah answer in each of the three types, more preferably about 5 to about 15 of the said pieces.

Such apparatus will also comprise sufficient of the two-sided balloting pieces to permit balloting by each of the intended number of players. Thus, desirably, the boxed apparatus will comprise about 5 to about 15 of said two-sided balloting pieces.

As will be appreciated, various modifications of the procedure for playing the game and of the above game player apparatus are possible. Thus, in the basic and full versions, while, as indicated above, a player's score may be recorded by subtracting from or adding to the number of question playing pieces which he holds in his hand, other methods of scoring are possible. For example, a register may be kept of each player's score, and, in the event of a match between the second player's answer and the type of answer indicated on the first player's answer playing piece, or a successful challenge, a score unit, for example 1, may be added to the register for the first player, kept, for example, on a note pad type score sheet or the like. Similarly, the loser of a challenge may have a score unit, e.g. 1, subtracted from his score. In such case, the winner may be the person who first reaches a target total score, or the person with the highest score after a definite time period.

In one aspect, the present invention provides a method of playing a game by a plurality of players, comprising:

(a) establishing a set of differing moral questions to each of which a positive, a negative or an indeterminate answer can be given;
(b) randomly selecting an answer from one of the three types, positive, negative and indeterminate, and disclosing the randomly selected answer to a first player;
(c) selecting by said first player (i) one of said questions from the set and (ii) a second player from the plurality of players to whom the selected question is to be posed;
(d) posing to the second player the question selected in step (c);
(e) comparing the second player's answer with the answer randomly selected in step (b);
(f) recording a score for the first player dependent on the outcome of the comparison of step (e); and
(g) repeating steps (b) to (f) for each of the players in turn.

It will be appreciated that both the basic or introductory form of the game and the modified or full form of the game are each readily adaptable for a game show format, for example a television game show format, for the entertainment of an audience wider than the circle of actual players. In a game show format, the answer randomly selected in step (b) above and, optionally, also the set of differing questions from among which the first player makes his selection, may be disclosed to the spectators, who thus have an opportunity to follow the thought processes involved in the selection procedure made by the first player. If the set of questions includes a sufficiently large number of questions, the set of questions may remain the same through all the players' turns, but each question, as it is selected and asked may be marked as being ineligible for future selection. When all the questions have been asked, a fresh set of questions may be provided. Equally, in the event of a challenge, instead of having the poll as to sincerity or insincerity of the second player's answer conducted among the actual circle of players, the poll may be made among a wider group, for example among the studio audience or other spectators in the event of a TV game show format of the game.

In a further aspect, the invention provides a method of playing a game by a plurality of players, comprising:

(a) establishing a set of differing moral questions, to each of which a positive, a negative or an indeterminate answer can be given;

(b) randomly selecting an answer from one of the three types positive, negative and indeterminate, and disclosing the selected answer to a first player;

(c) selecting by the first player (i) one of said questions from the set and (ii) a second player from the plurality of players to whom the selected question is to be posed;

(d) posing to the second player the question selected in step (c);

(e) comparing the second player's answer with the answer randomly selected in step (b);

(f) permitting any player other than the second to elect to challenge the sincerity of the second player's answer;

(g) in the event of such any other player electing to make such challenge, conducting a poll of a selected group of persons and determining whether a majority of said selected group consider the second player's answer is sincere or is insincere, and recording a score for the second and said any other player dependent on such determination;

(h) recording a score for the first player dependent on the outcome of the comparison of step (e); and (i) repeating steps (b) to (h) for each of the players in turn.

Figure 1B:
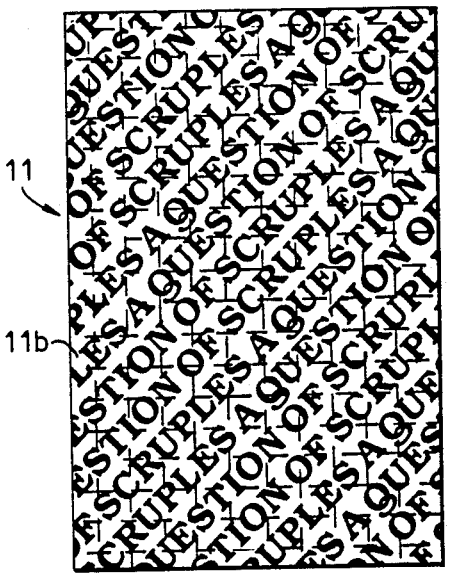
Figure 3A:
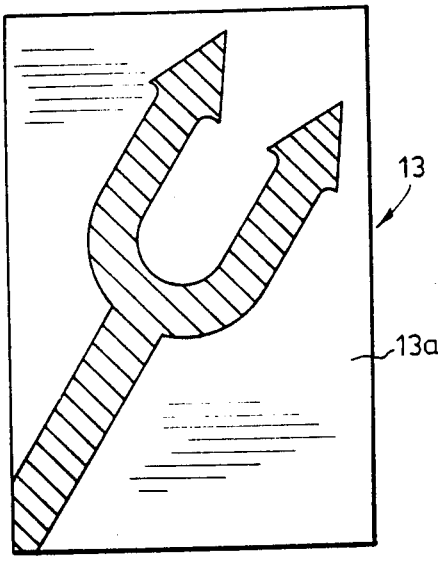
Figure 3B:
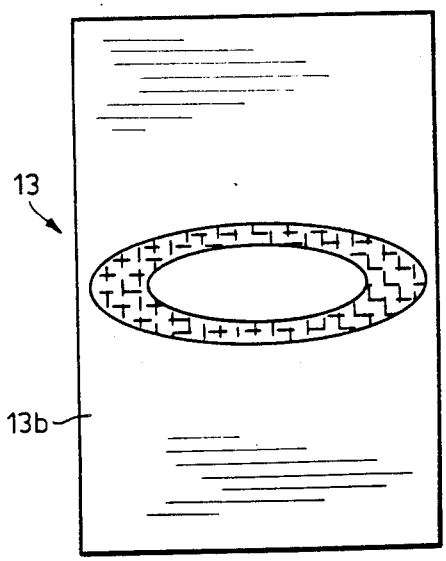

An example of one form of apparatus for games playing is described in more detail hereafter with reference to the drawings, wherein:

FIG. 1*a* shows the front side of one of the question cards;

FIG. 1*b* shows the reverse side of one of the question cards;

FIG. 2*a* shows the reverse side of one of the answer cards;

FIGS. 2*b*, 2*c* and 2*d* show the front sides of the three types of answer cards; and FIGS. 3*a* and 3*b* show the opposite sides of one of the balloting cards.

Referring to the drawings, in the preferred form the apparatus comprises sets of rectangular thin cards printed on each side, and provided packaged in a box containing also a printed sheet containing the rules to be observed in the playing of the game. A first set of cards, preferably consisting of about 245 cards, and for convenience referred to herein as question cards, are similar to the card 11 shown in FIGS. 1*a* and 1*b*. The reverse side 11*b* of each of the question cards, which are thus indistinguishable one from another, when seen from these reverse sides, is of a first distinctive appearance. For example, as shown in FIG. 1*b*, the reverse side in each case may consist of a printed solid ground, and on it a printing of the title of the game for example "A QUESTION OF SCRUPLES" disposed in a repeat pattern. The printed material may be in a distinctive light colour, for example yellow.

The front side of each of the question cards carries a differing moral question, to which a positive answer "yes", a negative answer "no" or an indeterminate answer, for example "depends" can be given. Examples of such questions include "You are a home owner. A social agency wants to establish a residence for seven retarded adults next door. Do you sign a petition opposing this step"? "The clerk at the garage forgets to charge for the $6.00 oil filter. You think the labour charge is too high. Do you mention the oil filter?" or "You are driving out of a parking lot, and dent a parked car. Do you leave a note with your name?"

The apparatus also includes a set of cards called for convenience herein answer cards. Each of the answer cards is, like the question cards, indistinguishable one from another when viewed from the reverse. Thus, each answer card 12 has a reverse side 12*a* as shown in FIG. 2*a* printed with a solid ground and a repeat pattern of the title of the game, with the printing in a light colour distinctive from that employed for the question cards 11. For example the printing for the reverse sides of the answer cards 12 may be orange. As shown in FIGS. 2*b* to 2*d*, the front sides of the answer cards 12 are printed with a legend indicating one of three types of answer, namely positive, negative or indeterminate. There is an equal number of each type of answer card. Preferably, there are ten answer cards having the front side 12*b*, as indicated in FIG. 2*b*, printed with the word YES, ten having their front side 12*c*, as shown in FIG. 2*c* printed with the word NO, and ten having their front side 12*d*, as shown in FIG. 2*d*, printed with the legend DEPENDS.

Also included in the boxed apparatus are a small number e.g. 10 balloting cards having on one side 13*a* as indicated in FIG. 3*a* a symbol such as the devil's fork, representing insincerity, and on the opposite side 13*b*, as shown in FIG. 3*b*, a symbol, for example the halo symbol, representing sincerity.

Desirably, the apparatus also includes a number of cards, e.g. 5 cards, printed on one side as shown for the reverse side 11*b* of the question cards 11, and thus indistinguishable therefrom when seen from the reverse side, and each, on their front side, bearing the printed legend "INVENT A QUESTION OF SCRUPLES". Preferably, the apparatus also includes a set of cards, e.g. 15 cards, printed on one side identically to the reverse side 11*b* of the question cards 11, and having the opposite side substantially blank, so that a user of the set can write in questions of his own devising.

The question cards 11 and the answer cards 12 are adapted for playing a basic version of the game, in accordance with the rules provided in the printed instructions inside the boxed apparatus, which may serve as a preliminary or introduction to a more complex or full form of the game which additionally employs the balloting cards 13. In the basic form of the game, firstly the answer cards 12 are shuffled and are placed in a pile with their front side down on a playing surface, for example a table.

About half of the question cards 11 are then taken and shuffled and are placed beside the answer cards 12, also with their front sides down.

A dealer is appointed who deals each player one answer card 12, carrying one of the three possible answers YES, NO and DEPENDS. Each player keeps the information contained on the front side of the answer card secret, and does not let any other player see the answer on the answer card which he holds.

Each player is now dealt a small number, e.g. five, of the question cards 11. Each player reads the questions indicated on the question cards which he holds, but does not show them to the other players.

A first player is appointed, who may be, for example, the person next to the dealer in the clockwise direction. In the game, each player takes turns posing any of the moral questions from the cards which he holds to any other player. If the first player, posing a question to a second player receives from the second player a "correct" answer, i.e. one which matches the answer given on the answer card 12 which he holds, he can dispose of the question card 11 on which the question appears. The first player has then reduced the number of question cards 11 in his hand, and has advanced toward winning. A player wins when he has disposed of all the question cards 11 in his hand.

If the second player gives a different answer from the one indicated on the first player's answer card 12, then the first player disposes of the question card 11, but must replace it with a new one from the stack of question cards 11. Thus, the first player will then have in his hand the same number of question cards as he started with, and will not have advanced towards winning. Regardless of the answer which he receives from the second player, after his turn the first player always disposes of his answer card 12 and picks up a fresh answer card 12, so that the other players will not know what answer is given on the answer card 12 which he holds. Desirably, the used question cards 11 and answer cards 12 are placed face up in a discard pile alongside their respective stacks. The pile of discarded question cards is reshuffled and used when the stack of question cards runs out.

Play then proceeds through each player in the group in turn. For example, the player next adjacent in the clockwise direction to the player who has just asked a question may be next to play. As will be appreciated, in playing the above described basic form of the game, the skill in asking a question lies in anticipating which of the players in the group is most likely to give the answer shown on the answer card 12 held by the player asking the question. The skill in answering a question consists in guessing what the questioner expects to receive as an answer, and in giving a different answer. In this form of a game, players are free to bluff in order to thwart their opponents.

In the basic version of the game, the rules provide that a person answering a question may answer yes or no without giving an explanation. If, however, he replies "depends" he must always say, without hesitation, on what his decision depends. Any explanation is acceptable. If a player forgets to say, or hesitates too long in saying on what facts his answer depends, he is penalized by having to draw an additional question card from the stack.

In the preferred form of play, the players play the above-described basic version in order to familiarize themselves with the mechanism or procedure of each turn. After playing a few rounds of the basic version, the players may proceed to the full or more complex version. Whereas in the basic version of the game there is no need for a player to be honest in the answer which he gives, and there is no discussion of the answers or of the questions, in the full version, more honesty in the form of answers which are given, and more discussion of the questions and of the answers is required.

The same order of play follows as described above, except that the answers given by a player can be challenged if they are considered untruthful. This reduces the element of chance in the game, and increases the amount of discussion which takes place between the players.

The balloting cards 13 described above are employed. In order to illustrate the full version, an example may be given. Supposing, for example, that the question asked by the first player is "You are driving out of a parking lot, and dent a parked car. Do you leave a note with your name?". Assuming that the second player's truthful answer would be yes, in the above-described basic version, the second player could bluff and could reply "depends if there were any witnesses". The first player would have been thwarted if he had a yes or no orange answer card 12. In the more complex version of the game, the second player can still reply "depends", but the first player can challenge the second player if he considers that the second player is bluffing or evading the truth. Under the rules provided in the preferred form of the game, the first player has a limited period, e.g. 20 seconds in which to convince the group of players that the second player is insincere. Thus, for example, he can argue "is this the face of a person who would damage someone's property and then sneak away"? He may cite examples of the second player's true honesty from his past, and from his answers given in the earlier rounds of the game. The second player then has a limited period, for example 20 seconds, to reply. He must convince the group of players that he is sincere. For example, he may argue that, if no one saw him, he would not leave a note because the damage would be covered by insurance. But if there was a witness, he would leave his name to avoid worse trouble. The challenger then has a final limited period e.g. 10 seconds to prove that the second player is bluffing, after which the other players can give their opinion if they wish. All players are then polled for their opinion as to the sincerity or insincerity of the second player's answer. The poll is conducted by each player placing on the table one balloting card 13 with the halo symbol as shown on side **13*b* upwards in the case of a vote for sincerity of the answer, while insincerity is indicated by placing the devil's fork symbol 13*a*** upwards. According to the rules of the game, the vote should be simultaneous. If the challenger wins the vote, i.e. the majority indicates that the second player is insincere, the challenger advances by giving to the second player a question card from his hand. If the second player wins the vote, he advances by giving the challenger a question card from his hand. If the vote is tied, no card is exchanged.

The first player or questioner has the first opportunity to challenge. He can challenge even if the second player gave the "correct" answer, i.e. an answer which matched the answer given on the answer card which the first player holds. However, first, he must put down his question card if he received the "correct" answer, or replace it if he got an "incorrect" answer. The result of the vote does not affect this outcome.

If the questioner decides not to challenge, he must say so, and then, any other player can challenge on a first come basis. A challenge can be made until the next player begins to address his question. The questioner does not benefit from the success of another player's challenge.

Players with only one question card left must win by getting a "correct" answer. They can neither challenge nor be challenged. This rule is intended to prevent the players combining to defeat a player left with only one question card. Thus, players who have only one question card left can bluff freely, and when it is such player's turn to ask a question, other players can bluff to them as freely. Other players, can, however, still challenge any answer they consider is a bluff.

In order to dispose of a question card with the legend "INVENT A QUESTION OF SCRUPLES", a questioner must either pose a question of his own making, or may give the card to someone who has challenged him and has lost, or who he has challenged successfully.

While one preferred form of game playing apparatus and one preferred form of method of playing games has been described above, it will be appreciated that various modifications and alterations may be made. For example, a modified form of the apparatus wherein the balloting cards 13 are omitted may be employed, since the balloting cards are not required for playing the basic form of the game. Most desirably, however, the playing apparatus includes such balloting cards or other balloting playing pieces, since such apparatus is then well adapted for playing the full version of the game described above.

In the method of playing the game, although, as described above, in the preferred form a score for a player when receiving a "correct" answer or when winning a challenge is registered by having the player dispose of a question card or other question playing piece, and, in the case of a player losing a challenge, is registered by such player accepting a question card or other question playing piece, it is, of course, possible to register scores in some other manner, for example by making a notation on a score pad or the like, and adding one unit to a player's score or subtracting a unit from a player's score in the event of a player losing a challenge. Such modification also presents the possibility that, in each player's turn, when he has posed a question, he will always replace his question card or other question playing piece with a fresh card or other playing piece regardless of whether or not he receives a "correct" answer. In such case, the game may be played for a duration prescribed by the rules or limited by agreement among the players, the winner being the person having the highest score, or the game may be played until a winner having a predetermined target score is declared.

In the method of playing the game, different modes of presentation of the questions and of the randomly preselected answers may be employed. For example, where the playing of the game is intended to be viewed by an audience larger than the circle of actual players, for example where the game is played in a game show format, a plurality of possible questions, together with the randomly preselected answer may be presented to the player who is to select a second player and who is to pose a question to him, on a panel or screen, for example a television screen, which is concealed from the other players, but is readily visible by the audience. If the plurality of possible questions is sufficiently large, the questions need not be changed for each player's turn. As each question is asked, it may be marked ineligible for future selection by any player. In such case, the set of questions may be on a panel or screen equally visible to all players and to the audience.

Further, as discussed above, in the event of a challenge, the vote as to sincerity or insincerity of an answer may be taken among the audience rather than among the players.

I claim:

1. Game playing apparatus comprising:

(a) a set of question playing pieces of like shape each having a front and a reverse side, said reverse sides each being of a first like appearance, and said front sides each bearing a legend posing a moral question to which a positive, a negative or an indeterminate answer may be given, each of said question playing pieces bearing a different moral question; and (b) a set of answer playing pieces of like shape each having a front side and a reverse side, said reverse sides each being of a second like appearance distinctive from said first like appearance and said front sides each bearing a legend indicating an answer from one of the three types of positive, negative and indeterminate, there being a plurality of answer playing pieces bearing answers in each of said three types.

2. Apparatus according to claim 1 additionally comprising:

(c) a set of two-sided ballotting pieces having on one side a symbol representing sincerity and on an opposite side a symbol representing insincerity whereby a player can ballot for the sincerity or insincerity of an answer expressed by another player by placing the ballotting card with the selected symbol uppermost on a playing surface.

3. Apparatus according to claim 1 wherein the question set of playing pieces includes pieces of said like shape and said first like appearance on the reverse side and a legend on the ide inviting a player to invent a moral question.

4. Apparatus according to claim 1 wherein the question set of playing pieces includes pieces of said like shape and said first like appearance on the reverse side and a blank space in which a moral question may be written.

5. Apparatus according to claim 1 wherein the answer set of playing pieces comprises an equal number of pieces bearing an answer in each of the three types.

6. Apparatus according to claim 1 wherein said question set comprises about 100 to 600 different questions.

7. Apparatus according to claim 1 wherein said question set comprises about 200 to 500 different questions.

8. Method of playing a game by a plurality of players, comprising:

(a) establishing a set of differing moral questions to each of which a positive, a negative or an indeterminate answer can be given;

(b) randomly selecting an answer from one of the three types, positive, negative and indeterminate, and disclosing the randomly selected answer to a first player;

(c) selecting by said first player (i) one of said questions from the set and (ii) identity of a second player from the plurality of players to whom the selected question is to be posed;

(d) posing to the second player the question selected in step (c);

(e) comparing the second player's answer with the answer randomly selected in step (b);

(f) recording a score for the first player dependent on the outcome of the comparison of step (e); and (g) repeating steps (b) to (f) for each of the players in turn.

9. Method of claim 8 wherein the step of recording a score comprises adding a score unit to a register thereof kept for said first player.

10. Method of playing a game by a plurality of players, comprising:

(a) establishing a set of differing moral questions, to each of which a positive, a negative or an indeterminate answer can be given;

(b) randomly selecting an answer from one of the three types positive, negative and indeterminate, and disclosing the selected answer to a first player;

(c) selecting by the first player (i) one of said questions from the set and (ii) a second player from the plurality of players to whom the selected question is to be posed;

(d) posing to the second player the question selected in step (c);

(e) comparing the second player's answer with the answer randomly selected in step (b);

(f) permitting any player other than the second to elect to challenge the sincerity of the second player's answer;

(g) in the event of such any other player electing to make such challenge, conducting a poll of a selected group of persons and determining whether a majority of said selected group consider the second player's answer is sincere or is insincere, and recording a score for the the second and said any other player dependent on such determination;

(h) recording a score for the first player dependent on the outcome of the comparison of step (e); and (i) repeating steps (b) to (h) for each of the players in turn.

11. Method of claim 10 wherein the polling of step (g) is conducted of said plurality of players playing the game.

12. Method of claim 10 wherein the polling of step (g) is conducted of a group of persons other than those playing the game.

13. Method of claim 10 wherein a score register is kept for each player and the step of recording a score for said second and said any other player comprises adding or subtracting a score unit to the registers thereof kept for them.

* * * * *